US008616922B2

(12) United States Patent
Liu et al.

(10) Patent No.: US 8,616,922 B2
(45) Date of Patent: Dec. 31, 2013

(54) AUDIO JACK CONNECTOR

(75) Inventors: Bo Liu, Guang-Dong (CN); Rui-Bo Zhan, Guang-Dong (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 56 days.

(21) Appl. No.: 13/405,232

(22) Filed: Feb. 24, 2012

(65) Prior Publication Data

US 2013/0225008 A1 Aug. 29, 2013

(51) Int. Cl.
*H01R 24/04* (2006.01)

(52) U.S. Cl.
USPC ..... 439/669

(58) Field of Classification Search
USPC ..... 439/669, 668
See application file for complete search history.

(56) References Cited

U.S. PATENT DOCUMENTS 7,470,153 B2 * 12/2008 Han et al. ..... 439/669
7,717,755 B2 * 5/2010 Zhang et al. ..... 439/669
7,775,837 B2 * 8/2010 Zhang ..... 439/669
7,789,712 B1 * 9/2010 Peng et al. ..... 439/668
8,070,528 B2 * 12/2011 Wang et al. ..... 439/668
8,100,726 B2 * 1/2012 Harlan et al. ..... 439/669
8,123,569 B2 * 2/2012 Little et al. ..... 439/669

* cited by examiner

*Primary Examiner* — Phuong Dinh
(74) *Attorney, Agent, or Firm* — Cheng-Ju Chiang

(57) ABSTRACT

An audio jack connector adapted for soldering on a circuit board and engaging with an audio plug connector includes an insulating housing and a plurality of terminals. The insulating housing has a main body, and an insertion portion connecting with one side of the main body. The insertion portion defines an insertion hole for receiving the audio plug connector therein. The main body defines a plurality of terminal grooves with bottoms thereof passing through a bottom surface of the main body. The insulating housing defines a plurality of mouths communicating between the insertion hole and the terminal grooves. The terminals are disposed in the terminal grooves. Each terminal has a contact portion projecting into the insertion hole through the mouth to electrically contact with the audio plug connector, and a soldering portion received in the bottom of the terminal groove to be soldered on the circuit board.

6 Claims, 4 Drawing Sheets

AUDIO JACK CONNECTOR

BACKGROUND OF THE INVENTION

1. Field of the Invention

The present invention generally relates to an audio jack connector, and more particularly to an audio jack connector capable of being soldered on a circuit board conveniently.

2. The Related Art

Currently, an audio jack connector adapted for engaging with an audio plug connector includes an insulating housing and a plurality of terminals. The insulating housing defines an accommodating chamber in a substantial middle thereof for inserting the audio plug connector therein. Two opposite sides of the insulating housing define a plurality of terminal grooves communicating with the accommodating chamber. Each of the terminals has a base portion, an elastic portion connecting with one end of the base portion, and a soldering portion connecting with the other end of the base portion. The terminals are disposed in the terminal grooves of the insulating housing with the elastic portions partially projecting into the accommodating chamber to electrically contact with the audio plug connector so as to realize an electrical connection between the audio jack connector and the audio plug connector, and the soldering portions projecting out of the insulating housing from the terminal grooves to be soldered on a circuit board. However, the soldering portions project out of the insulating housing and are located outside the two opposite sides of the insulating housing that brings inconvenience for the audio jack connector to be soldered on the circuit board.

SUMMARY OF THE INVENTION

An object of the present invention is to provide an audio jack connector adapted for soldering on a circuit board and engaging with an audio plug connector includes an insulating housing and a plurality of terminals. The insulating housing has a main body, and an insertion portion connecting with one side of the main body. The insertion portion defines an insertion hole extending along a front-to-rear direction to penetrate through a front face and a rear face of the insertion portion for receiving the audio plug connector therein. The main body defines a plurality of terminal grooves with bottoms thereof passing through a bottom surface of the main body. The insulating housing defines a plurality of mouths communicating between the insertion hole and the terminal grooves. The terminals are disposed in the terminal grooves of the main body of the insulating housing. Each terminal has a contact portion forming at one side thereof projecting into the insertion hole of the insulating housing through the mouth to electrically contact with the audio plug connector, and a soldering portion forming at a bottom thereof received in the bottom of the terminal groove to be soldered on the circuit board.

As described above, the soldering portions received in the bottoms of the terminal grooves are located at a same side of the insertion hole of the insulating housing on account of the terminal grooves being located at the same side of the insertion hole of the insulating housing. So that the soldering portions of the terminals are soldered on the circuit board conveniently.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
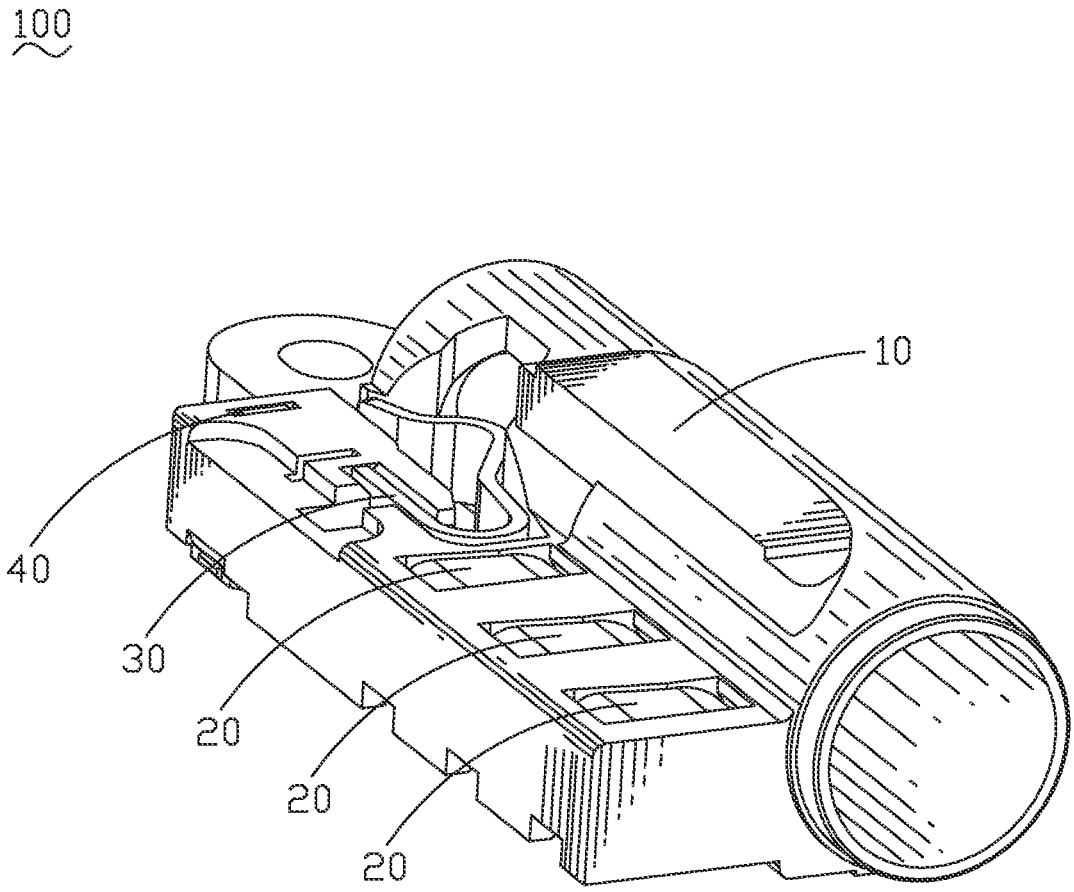
FIG. 1 is a perspective view of an audio jack connector in accordance with the present invention.
Figure 2:
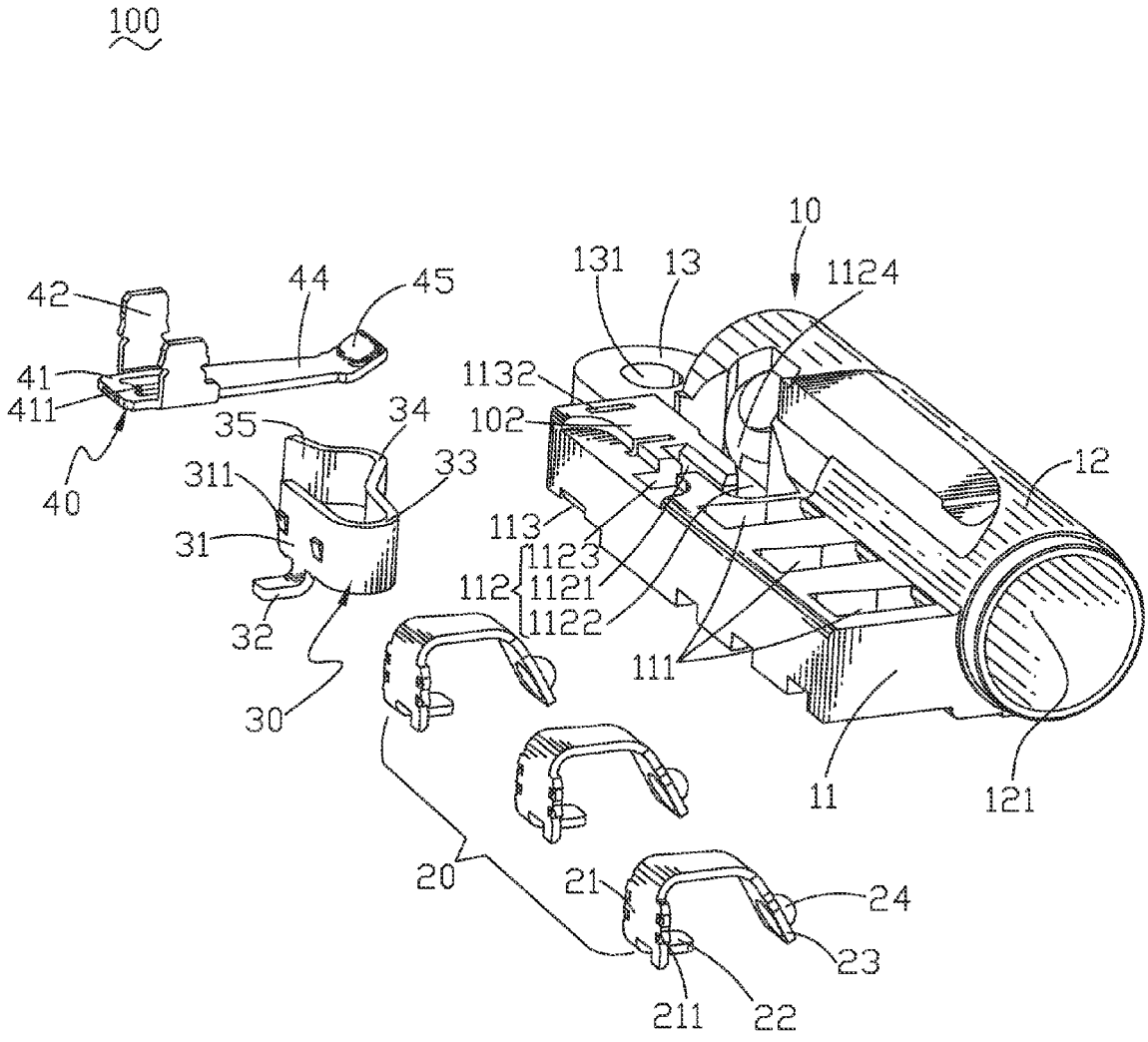
FIG. 2 is an exploded view of the audio jack connector of FIG. 1.

With reference to FIGS. 1-2, an audio jack connector 100 in accordance with the present invention is shown. The audio jack connector 100 adapted for soldering on a circuit board (not shown) and engaging with an audio plug connector (not shown) includes an insulating housing 10, a plurality of first terminals 20, a second terminal 30 and a third terminal 40.

Figure 3:
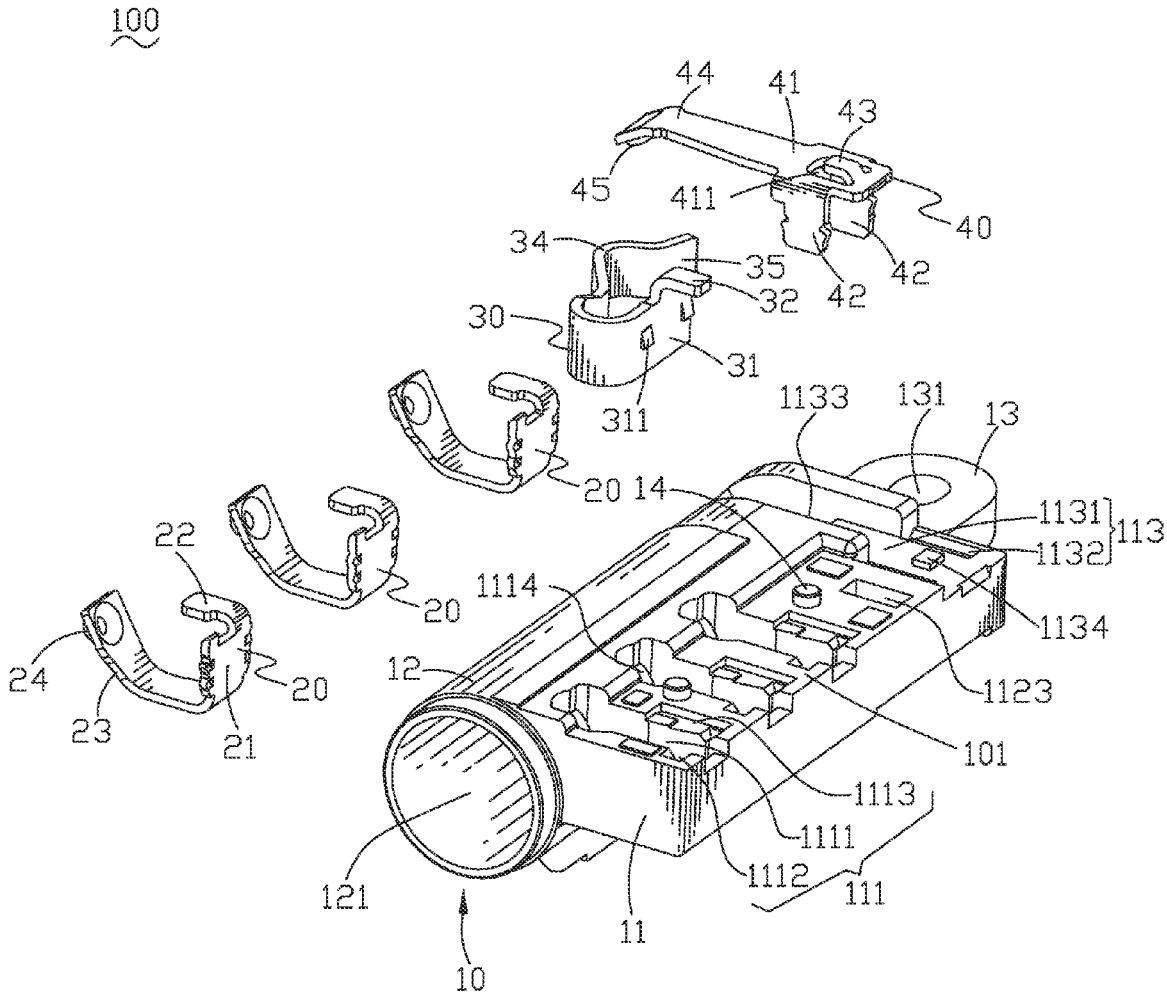
FIG. 3 is another exploded view of the audio jack connector of FIG. 1.
Figure 4:
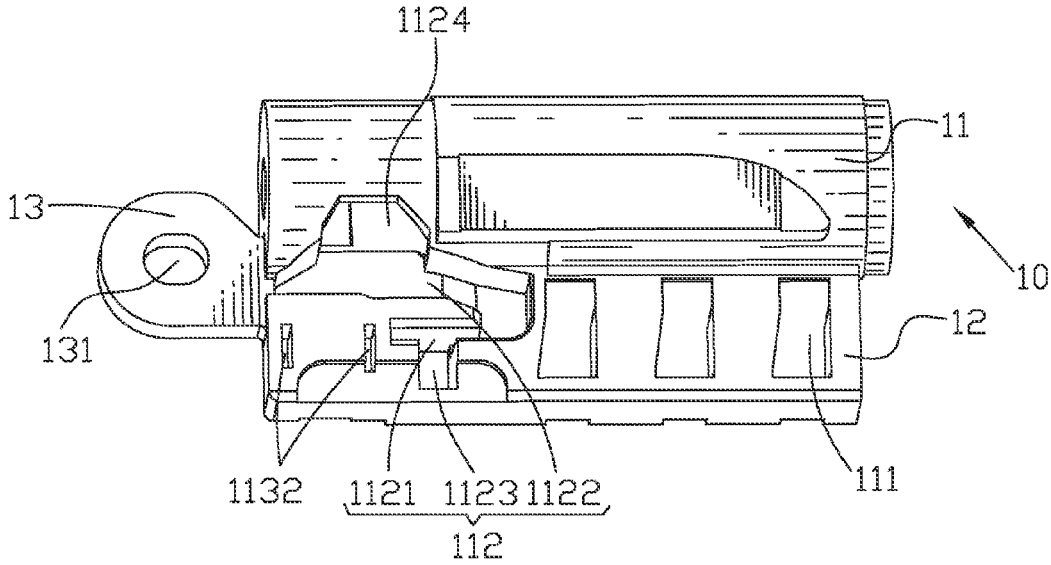
FIG. 4 is a perspective view of an insulating housing of the audio jack connector of FIG. 1.
Figure 5:
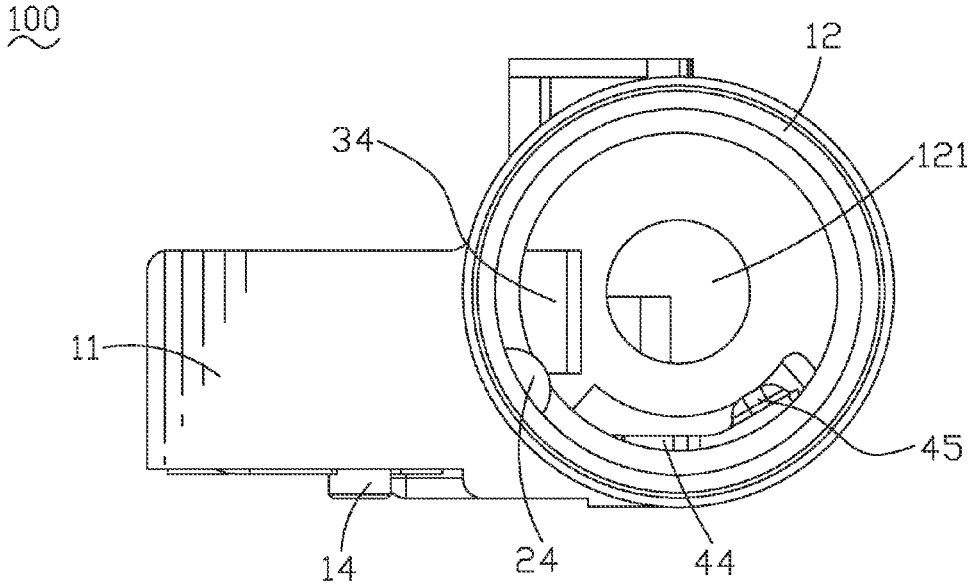
FIG. 5 is a front view of the audio jack connector of FIG. 1.

Referring to FIG. 2, FIG. 3 and FIG. 4, the insulating housing 10 has a main body 11 of a substantial rectangular shape, and a cylindrical insertion portion 12 connecting with one side of the main body 11. A middle of a rear end of the insulating housing 10 extends rearward to form a connecting piece 13 with a connecting hole 131 being defined therein. The audio jack connector 100 is mounted to an electronic product (not shown) through the connecting hole 131 of the connecting piece 13. A bottom surface 101 of the main body 11 defines two fastening pillars 14 mounted to a circuit board (not shown) to locate the audio jack connector 100 on the circuit board.

The insertion portion 12 defines an insertion hole 121 extending along a front-to-rear direction to penetrate through a front face and a rear face of the insertion portion 12. The main body 11 defines a plurality of first terminal grooves 111 arranged at regular intervals along the front-to-rear direction, a second terminal groove 112 and a third terminal groove 113. So the first terminal grooves 111, the second terminal groove 112 and the third terminal groove 113 are located at a same side of the insertion hole 121 of the insulating housing 10. Each of the first terminal grooves 111 includes a locating groove 1111 vertically penetrating through the main body 11, two fastening slots 1112 concaved oppositely from two bottoms of two opposite inner sidewalls of the locating groove 1111, and a receiving groove 1113 recessed inward in the bottom surface 101 of the main body 11 and communicating with the locating groove 1111. A first mouth 1114 penetrates through a sidewall of the locating groove 1111 adjacent to the insertion hole 121 to communicate between the locating groove 1111 and the insertion hole 121. The third terminal groove 113 includes a passage 1131 extending transversely in a rear end of the bottom surface 101 of the main body 11, and two insertion slots 1132 vertically penetrating through two opposite sides of a top sidewall of the passage 1131. A third mouth 1133 is opened in a rear end of a bottom of the insertion portion 12 to communicate between the insertion hole 121 and an inner end of the passage 1131. A blocking block 1134 protrudes downward at the top sidewall of the passage 1131 and is located between the two insertion slots 1132. The second terminal groove 112 includes a fastening groove 1121 opened in a top surface 102 of the main body 11 and located between the first terminal grooves 111 and the third terminal groove 113, a holding groove 1122 crankling towards the insertion portion 12 and then extending rearward from a front end of the fastening groove 1121, and a soldering groove 1123 penetrating vertically through the main body 11 and connecting with a middle of an outer side of the fastening groove 1121. A rear of one side of the insertion portion 12 adjacent to the main body 11 defines a second mouth 1124 communicating between the insertion hole 121 and a rear end of the holding groove 1122. The soldering groove 1123 is in alignment with the receiving grooves 1113 and the insertion slots 1132 along the front-to-rear direction.

Referring to FIG. 2 and FIG. 3, the first terminals 20 are designated as a microphone terminal, a ground terminal and a signal terminal in sequence along the front-to-rear direction. Each of the first terminals 20 has a first base portion 21 with a plurality of protrusions 211 protruding outward from two opposite sides thereof. One side of a bottom of the first base portion 21 bends towards a direction perpendicular to the first base portion 21 to form a first soldering portion 22. A top of the first base portion 21 bends towards the same direction as the bend direction of the first soldering portion 22, and then is inclined downward and away from the first base portion 21 to form a first elastic portion 23. An outer face of a free end of the first elastic portion 23 is arched outward to form a semicircle first contact portion 24.

Referring to FIG. 2 and FIG. 3, the second terminal 30 for transmitting signals has a second base portion 31 disposed vertically. A middle of a bottom of the second base portion 31 bends towards a direction perpendicular to the second base portion 31 to form a second soldering portion 32. A front end of the second base portion 31 is curved sideward to form a second elastic portion 33. A free end of the second elastic portion 33 is arched away from the second base portion 31 to form a second contact portion 34. A free end of the second contact portion 34 bends rearward to form a tail portion 35. Two opposite faces of the second base portion 31 are oppositely punched outward to form a plurality of buckling portions 311.

Referring to FIG. 2 and FIG. 3, the third terminal 40 with a detecting function has a third base portion 41 disposed horizontally. Two opposite side edges of one end of the third base portion 41 bend upward to form two clipping portions 42. The third base portion 41 defines an opening 411 located between the two clipping portions 42. One sidewall of the opening 411 extends slantwise downward, and then towards the opposite sidewall of the opening 411 to form a third soldering portion 43. The other end of the third base portion 41 extends towards a direction opposite to the third base portion 41, and then is inclined upward to form a third elastic portion 44. A top of a free end of the third elastic portion 44 is convex upward to form a third contact portion 45.

Referring to FIGS. 1-5, when the audio jack connector 100 is assembled, the first terminals 20 are disposed upward to the first terminal grooves 111 respectively, the second terminal 30 is disposed downward to the second terminal groove 112 and the third terminal 40 is disposed upward to the third terminal groove 113. Specifically, a middle of the first base portion 21 and the first elastic portion 23 are located in the locating groove 1111, the two opposite sides of the first base portion 21 are fastened in the fastening slots 1112, the first contact portion 24 projects into the insertion hole 121 through the first mouth 1114, and the first soldering portion 22 is received in the receiving groove 1113. The protrusions 211 interfere with two opposite inner sidewalls of the two fastening slots 1112 to fasten the first terminals 20 to the first terminal grooves 111 firmly. The second base portion 31 is fastened in the fastening groove 1121 with the buckling portions 311 interfering with two opposite inner sidewalls of the fastening groove 1121, the second soldering portion 32 is located in the soldering groove 1123, the second contact portion 34 projects into the insertion hole 121 through the second mouth 1124, and the second elastic portion 33 and the tail portion 35 are located in the holding groove 1122. The third base portion 41 is located in the passage 1131, the clipping portions 42 are inserted in the insertion slots 1132, the blocking block 1134 projects into the opening 411 to prop up the third soldering portion 43, and the third elastic portion 44 and the third contact portion 45 project into the insertion hole 121 through the third mouth 1133. The first soldering portion 22, the second soldering portion 32 and the third soldering portion 43 are flush with the bottom surface 101 of the main body 11. The first soldering portions 22 received in the receiving grooves 1113, the second soldering portion 32 located in the soldering groove 1123 and the third soldering portion 43 propped up by the blocking block 1134 which is located between the two insertion slots 1132 are located at the same side of the insertion hole 121 of the insulating housing 10 and in alignment with one another along the front-to-rear direction.

Referring to FIGS. 1-5, in use, the first soldering portions 22 of the first terminals 20, the second soldering portion 32 of the second terminal 30 and the third soldering portion 43 of the third terminal 40 are soldered on the circuit board conveniently. When the audio plug connector is inserted into the insertion hole 121 of the insulating housing 10, the first contact portions 24 of the first terminals 20, the second contact portion 34 of the second terminal 30 and the third contact portion 45 of the third terminal 40 project into the insertion hole 121 to electrically contact with the audio plug connector so as to realize an electrical connection between the audio jack connector 100 and the audio plug connector. So that, the first terminals 20 realize the microphone function, the ground function and the signal transmission function, respectively. The second terminal 30 transmits signals between the audio jack connector 100 and the audio plug connector. The third terminal 40 realizes the detecting function of the audio plug connector 100. Moreover, insertion and withdrawal force of the audio plug connector is controlled by means of modulating arc curvature of the second contact portion 34 of the second terminal 30.

As described above, the first soldering portions 22 received in the receiving grooves 1113, the second soldering portion 32 located in the soldering groove 1123 and the third soldering portion 43 propped up by the blocking block 1134 which is located between the two insertion slots 1132 are located at the same side of the insertion hole 121 of the insulating housing 10 and in alignment with one another along the front-to-rear direction on account of the receiving grooves 1113 of the first terminal grooves 111, the soldering groove 1123 of the second terminal groove 112 and the insertion slots 1132 of the third terminal groove 113 being located at the same side of the insertion hole 121 of the insulating housing 10 and being in alignment with one another along the front-to-rear direction. So that the first soldering portions 22 of the first terminals 20, the second soldering portion 32 of the second terminal 30 and the third soldering portion 43 of the third terminal 40 are soldered on the circuit board conveniently.

What is claimed is:

1. An audio jack connector adapted for soldering on a circuit board and engaging with an audio plug connector, comprising:

an insulating housing having a main body, and an insertion portion connecting with one side of the main body, the insertion portion defining an insertion hole extending along a front-to-rear direction to penetrate through a front face and a rear face of the insertion portion for receiving the audio plug connector therein, the main body defining a plurality of terminal grooves with bottoms thereof passing through a bottom surface of the main body, the insulating housing defining a plurality of mouths communicating between the insertion hole and the terminal grooves; and a plurality of terminals disposed in the terminal grooves of the main body of the insulating housing, each terminal having a contact portion forming at one side thereof projecting into the insertion hole of the insulating housing through the mouth to electrically contact with the audio plug connector, and a soldering portion forming at a bottom thereof received in the bottom of the terminal groove to be soldered on the circuit board;

wherein the terminal grooves are designated as a plurality of first terminal grooves, a second terminal groove and a third terminal groove, the terminals are designated as a plurality of first terminals disposed to the first terminal grooves respectively, a second terminal disposed to the second terminal groove and a third terminal disposed to the third terminal groove, the mouths are designated as a plurality of first mouths, a second mouth and a third mouth, the first mouths communicate between the insertion hole and the first terminal grooves respectively, the second mouth communicates between the insertion hole and the second terminal groove, and the third mouth communicates between the insertion hole and the third terminal groove, each of the first terminal grooves includes a locating groove vertically penetrating through the main body, two fastening slots concaved oppositely from two bottoms of two opposite inner sidewalls of the locating groove, and a receiving groove recessed inward in the bottom surface of the main body and communicating with the locating groove, the first mouth penetrates through a sidewall of the locating groove adjacent to the insertion hole, each of the first terminals has a first base portion, a bottom of the first base portion bends towards a direction perpendicular to the first base portion to form a first soldering portion received in the receiving groove, a top of the first base portion bends towards the same direction as the bend direction of the first soldering portion, and then is inclined downward and away from the first base portion to form a first elastic portion, an outer face of a free end of the first elastic portion is arched outward to form a first contact portion projecting into the insertion hole through the first mouth, a middle of the first base portion and the first elastic portion are located in the locating groove, and two opposite sides of the first base portion are fastened in the fastening slots.

2. The audio jack connector as claimed in claim 1, wherein a plurality of protrusions protrudes outward from the two opposite sides of the first base portion to interfere with two opposite inner sidewalls of the two fastening slots.

3. The audio jack connector as claimed in claim 1, wherein the soldering portions of the terminals are flush with the bottom surface of the main body of the insulating housing, and in alignment with one another.

4. An audio jack connector adapted for soldering on a circuit board and engaging with an audio plug connector, comprising:

an insulating housing having a main body, and an insertion portion connecting with one side of the main body, the insertion portion defining an insertion hole extending along a front-to-rear direction to penetrate through a front face and a rear face of the insertion portion for receiving the audio plug connector therein, the main body defining a plurality of terminal grooves with bottoms thereof passing through a bottom surface of the main body, the insulating housing defining a plurality of mouths communicating between the insertion hole and the terminal grooves; and a plurality of terminals disposed in the terminal grooves of the main body of the insulating housing, each terminal having a contact portion forming at one side thereof projecting into the insertion hole of the insulating housing through the mouth to electrically contact with the audio plug connector, and a soldering portion forming at a bottom thereof received in the bottom of the terminal groove to be soldered on the circuit board;

wherein the terminal grooves are designated as a plurality of first terminal grooves, a second terminal groove and a third terminal groove, the terminals are designated as a plurality of first terminals disposed to the first terminal grooves respectively, a second terminal disposed to the second terminal groove and a third terminal disposed to the third terminal groove, the mouths are designated as a plurality of first mouths, a second mouth and a third mouth, the first mouths communicate between the insertion hole and the first terminal grooves respectively, the second mouth communicates between the insertion hole and the second terminal groove, and the third mouth communicates between the insertion hole and the third terminal groove, the third terminal groove includes a passage extending transversely in a rear end of the bottom surface of the main body, and two insertion slots vertically penetrating through two opposite sides of a top sidewall of the passage, the third mouth is opened in a rear end of a bottom of the insertion portion and connected with an inner end of the passage, a blocking block protrudes downward at the top sidewall of the passage and is located between the two insertion slots, the third terminal has a third base portion of which two opposite side edges of one end bend upward to form two clipping portions inserted in the insertion slots, the third base portion defines an opening located between the two clipping portions, one sidewall of the opening extends slantwise downward and then towards the opposite sidewall of the opening to form a third soldering portion, the other end of the third base portion extends towards a direction opposite to the third base portion, and then is inclined upward to form a third elastic portion, a top of a free end of the third elastic portion is convex upward to form a third contact portion, the third base portion is located in the passage, the third elastic portion and the third contact portion project into the insertion hole through the third mouth, the blocking block projects into the opening to prop up the third soldering portion.

5. An audio jack connector adapted for soldering on a circuit board and engaging with an audio plug connector, comprising:

an insulating housing having a main body, and an insertion portion connecting with one side of the main body, the insertion portion defining an insertion hole extending along a front-to-rear direction to penetrate through a front face and a rear face of the insertion portion for receiving the audio plug connector therein, the main body defining a plurality of terminal grooves with bottoms thereof passing through a bottom surface of the main body, the insulating housing defining a plurality of mouths communicating between the insertion hole and the terminal grooves; and a plurality of terminals disposed in the terminal grooves of the main body of the insulating housing, each terminal having a contact portion forming at one side thereof projecting into the insertion hole of the insulating housing through the mouth to electrically contact with the audio plug connector, and a soldering portion forming at a bottom thereof received in the bottom of the terminal groove to be soldered on the circuit board;

wherein the terminal grooves are designated as a plurality of first terminal grooves, a second terminal groove and a third terminal groove, the terminals are designated as a plurality of first terminals disposed to the first terminal grooves respectively, a second terminal disposed to the second terminal groove and a third terminal disposed to the third terminal groove, the mouths are designated as a plurality of first mouths, a second mouth and a third mouth, the first mouths communicate between the insertion hole and the first terminal grooves respectively, the second mouth communicates between the insertion hole and the second terminal groove, and the third mouth communicates between the insertion hole and the third terminal groove, the second terminal groove includes a fastening groove opened in a top surface of the main body and located between the first terminal grooves and the third terminal groove, a holding groove crankling towards the insertion portion and then extending rearward from a front end of the fastening groove, and a soldering groove penetrating vertically through the main body and connecting with an outer side of the fastening groove, the second mouth is opened at a rear of one side of the insertion portion adjacent to the main body and connected with a rear end of the holding groove, the second terminal has a second base portion fastened in the fastening groove, a bottom of the second base portion bends towards a direction perpendicular to the second base portion to form a second soldering portion located in the soldering groove, a front end of the second base portion is curved sideward to form a second elastic portion located in the holding groove, a free end of the second elastic portion is arched away from the second base portion to form a second contact portion projecting into the insertion hole through the second mouth.

6. The audio jack connector as claimed in claim 5, wherein two opposite faces of the second base portion are oppositely punched outward to form a plurality of buckling portions interfering with two opposite inner sidewalls of the fastening groove.

* * * * *